US005096186A

United States Patent [19]

Wilkinson et al.

[11] Patent Number: 5,096,186

[45] Date of Patent: Mar. 17, 1992

[54] AEROBIC CLIMBING STEP/BENCH

[75] Inventors: William T. Wilkinson, 1717 Town Point Rd., Chesapeake City, Md. 21915; Peter W. Bressler, Philadelphia, Pa.

[73] Assignee: William T. Wilkinson, Chesapeake City, Md.

[21] Appl. No.: 615,243

[22] Filed: Nov. 19, 1990

[51] Int. Cl.[5] ..... A63B 5/00

[52] U.S. Cl. ..... 272/70; 248/912; 248/188; 211/175; 108/12; 297/438; 403/3

[58] Field of Search ..... 272/65, 70, 93, 144, 272/DIG. 4; 403/94; 297/423, 424, 438, 439, 445, 461, 463; 108/11, 12, 19, 156, 157, 159, 144; 248/188, 188.8, 188.2, 911, 912, 558; 211/175, 207, 208

[56] References Cited

U.S. PATENT DOCUMENTS

| | | | |
|---|---|---|---|
| 314,831 | 3/1885 | Hardy | 248/161 |
| 1,978,650 | 10/1934 | Shannon | 108/156 |
| 2,750,709 | 6/1956 | Saverno | 248/558 |
| 3,865,050 | 2/1975 | Cecchetti | 108/156 |
| 4,011,821 | 3/1977 | Neal | 108/156 |
| 4,815,394 | 3/1989 | Ettlinger et al. | 108/144 |
| 4,852,837 | 8/1989 | Merten et al. | 108/156 |
| 4,872,630 | 10/1989 | Cooper | 248/558 |
| 4,903,614 | 2/1990 | Johnson | 108/12 |

FOREIGN PATENT DOCUMENTS

| | | | |
|---|---|---|---|
| 7511686 | 4/1976 | Netherlands | 108/144 |

OTHER PUBLICATIONS

Remar Sutton, *The Washington Post*, 9/24/90, section B5.

*Primary Examiner*—Richard J. Apley
*Assistant Examiner*—L. Thomas
*Attorney, Agent, or Firm*—Connolly & Hutz

[57] ABSTRACT

An exercise step/bench for aerobic climbing and dance includes a base in the form of a horizontal platform generally rectangularly shaped with a downwardly extending apron. Each corner of the platform is provided with a plurality of leg receiving openings. A leg is provided for each corner and is constructed so as to be reversibly mounted in its respective corner thus providing height adjustability in accordance with the orientation of the leg and the selection of the particular opening into which the leg is mounted.

17 Claims, 2 Drawing Sheets

AEROBIC CLIMBING STEP/BENCH

BACKGROUND OF THE INVENTION

Various devices exist for use in an aerobic exercise program. One type of device which has met with great success is a bench or step for aerobic step or climbing. For example, a form of single step climbing has been developed during which the user would repeatedly step up and down from a single step. An important feature for making the device capable of wide spread appeal is to permit it to be customized to the needs of the particular user in height adjustability. In U.S. Pat. No. 4,340,218 issued to William T. Wilkinson there is disclosed one manner of achieving this height adjustability. Other patents and pending applications of William T. Wilkinson disclose other useful variations for accomplishing that result.

SUMMARY OF THE INVENTION

An object of this invention is to provide an exercise device for simulating climbing which is compact and lightweight and capable of being conveniently stored and transported.

A further object of this invention is to provide such device which may offer a wide variety of incremental heights that are easily and quickly adjustable to accommodate the needs of the particular user.

A further object of this invention is to provide an unobstructed platform surface so that the user can easily step on and off in any direction.

A still further object of this invention is to provide such a device which may be mass produced inexpensively and in a simple design.

A yet further object of this invention is to provide such a device which may be used as an elevated platform or bench for warm-up exercises.

In accordance with this invention, a device of the type disclosed in co-pending application Ser. No. 533,004 filed June 4, 1990, is provided which is modified in its leg structure and in its corner structure. In this respect, the device includes a horizontal platform having a downwardly extending peripheral apron with each corner provided with at least two leg receiving openings. At least one leg is provided for each corner. Each leg may be reversably mounted in one of two positions in a selective one of the openings at each corner. As a result, it is possible to provide height adjustability in accordance with the selection of the particular opening and further in accordance with the orientation of the leg in that opening.

In one practice of this invention, each leg is provided with a stop located closer to one end than the other. The stop limits the amount to which the leg may be inserted into its respective opening.

The invention may be practiced with one of the openings at each corner exposed on the upper surface. The openings at each corner may be of different depths to provide height adjustability or the openings may be at different levels in the downwardly extending apron. Grooves may be provided inside the holes to act as stop locations in cooperation with beads or projections on the legs.

THE DRAWINGS

DETAILED DESCRIPTION

The present invention is directed to the type of aerobic climbing step/bench as described in co-pending application Ser. No. 07/533,004 filed June 4, 1990, and of the type of device disclosed in Ser. No. 07/588,449 filed Sept. 26, 1990, details of which are incorporated herein by reference thereto. The present invention is directed to variations thereof with regard to the corner structure and the leg structure of the device for achieving the desired height adjustability.

Figure 1:
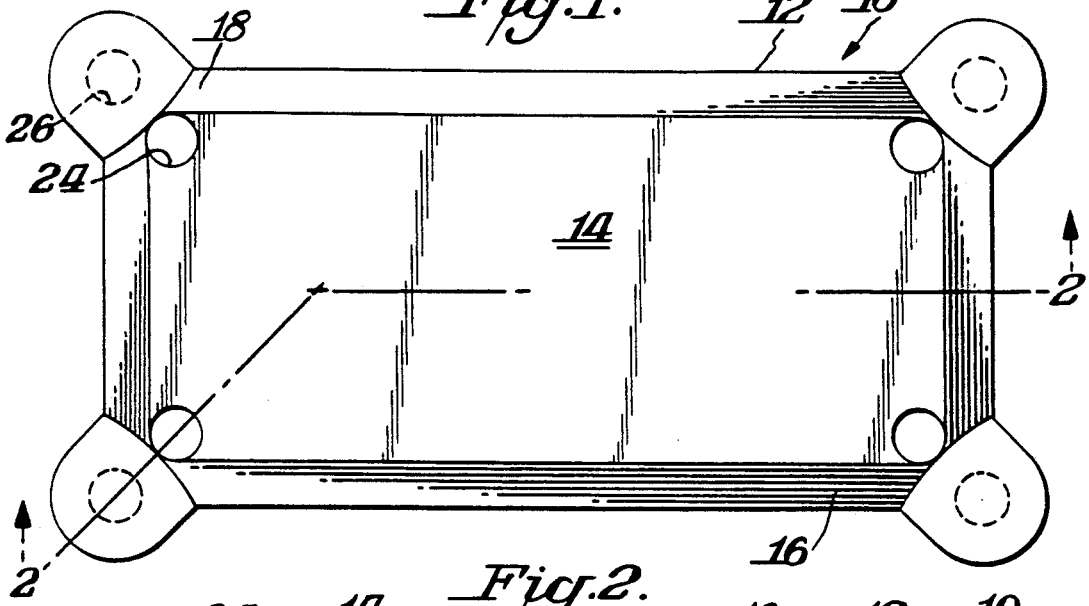
FIG. 1 is a top plan view of an aerobic climbing step/bench device in accordance with this invention.
Figure 2:
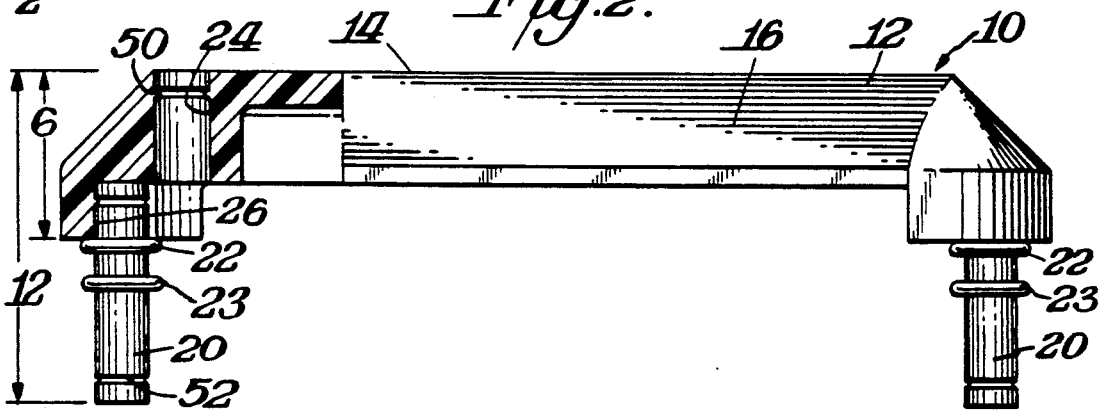
FIG. 2 is a cross-sectional view taken through FIG. 1 along the line 2—2.
Figure 3:
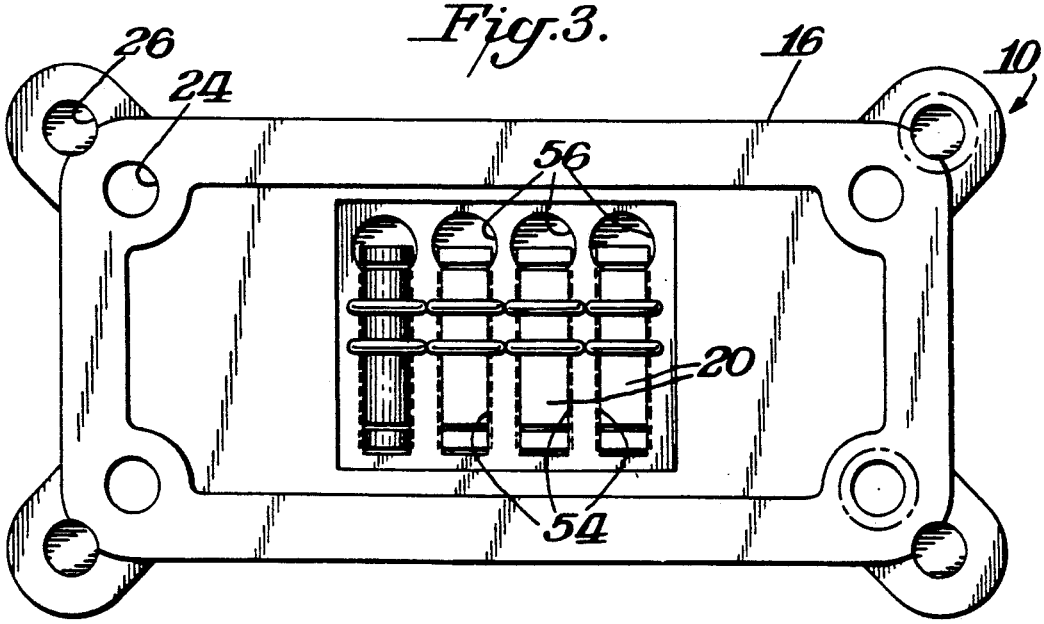
FIG. 3 is a bottom plan view of the device shown in FIGS. 1–2 with the legs in their stored condition.

FIGS. 1–3 illustrate a device 10 which may function as a step/bench in accordance with this invention. As shown therein device 10 includes a base 12 in the form of a horizontal platform 14 having a downwardly and outwardly extending apron 16. If desired, apron 16 may be perpendicular to platform 14. A leg 20 is mounted in each corner 18 of base 12.

Figure 4:
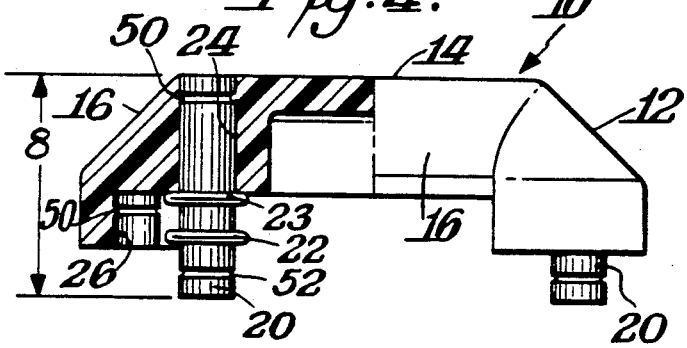
FIG. 4 is an end elevation view partly in section with a leg shown mounted in a different hole than in FIG. 2 and in a reverse condition.
Figure 5:
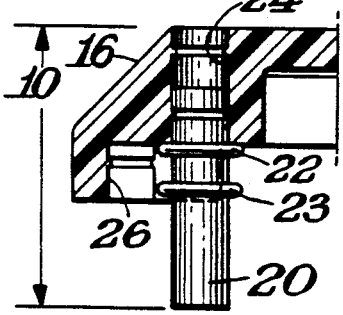
FIG. 5 is a view similar to FIG. 4 showing an alternative practice of this invention.

Leg 20 may be of any suitable form. In the preferred practice of this invention leg 20 is tubularly shaped, such as being of an extruded plastic which is hollow and of uniform thickness. Annular projections in the form of rounded rings 22,23 are mounted on the outer surface of leg 20 to act as stops or abutments. In accordance with this invention each corner 18 of base 12 is provided with a plurality and preferably two leg receiving openings or pockets 24,26. Opening 24 extends the complete thickness of platform 14 and may be exposed at its upper surface or the upper surface may contain a thin web covering the upper portion of opening 24. Opening 26 is located in the portion of apron 16 which terminates below the lower portion of opening 24. Additionally, opening 26 extends only partially into apron 16 so that the length of opening 26 is less than the length of opening 24. In the embodiment shown in FIG. 2, the overall height of base 12 from the bottom of apron 16 to the top surface of platform 14 is, for example, 6 inches. Thus, platform 14 may be elevated at a height six inches when no legs are inserted in the openings. The elevation may be raised another two inches by inserting leg 20 into opening 24 until ring 23 abuts against the lower surface of platform 14 as shown in FIG. 4. Thus, as shown in FIG. 4 the elevation of platform 14 is eight inches. When leg 20 is reversed in its orientation as shown in FIG. 5 and leg 20 is inserted into opening 24, ring 22 engages the lower surface of platform 14 and the extension provided by the remainder of leg 20 results in platform 14 being at a height of ten inches. When leg 20 is inserted into opening 26 as shown in FIG. 2, and ring or projection 22 abuts against the lower surface of apron 16 the overall height of platform 14 is twelve inches. Accordingly, by the selection of the orientation of leg 20 into its respective opening and by the selection of that opening or by the complete omission of any leg it is possible to increase the overall height of platform 14 in two inch increments from six inches to twelve inches which is the preferred dimensional range required by a user of the exercise program.

It is to be understood that the dimensions previously described are exemplary of one practice of the invention. Other dimensions may be achieved by varying the dimensions of device 10 including the lengths of legs 20 and openings 24, 26.

Figure 6:
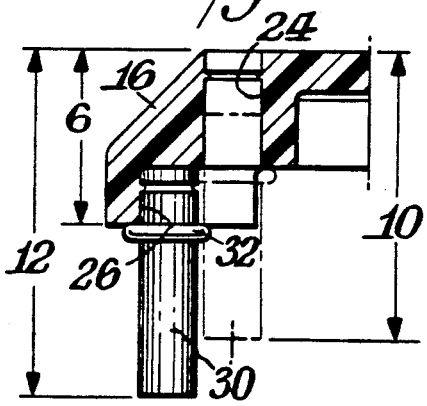
FIG. 6 is a view similar to FIG. 5 showing yet another practice of this invention.

FIG. 6 shows an alternative practice of the invention wherein each leg 30 includes a single annular projection 32 located closer to one end than the other. Leg 30 is dimensioned so that when no leg is inserted in base 10 the overall height of platform 14 would be six inches. When, however, leg 30 is inserted into opening 24, as shown in phantom in FIG. 6, the overall height of platform 14 would be ten inches. When leg 30 is inserted into opening 26 in apron 16, as shown in full lines in FIG. 6, the overall height of platform 14 would be twelve inches. Accordingly, the single leg may provide height adjustability in generally two inch increments of from six inches to twelve inches without any reverse orientation of the leg.

Figure 7:
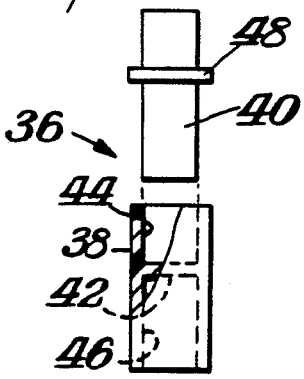
FIG. 7 is a front elevation view of a modified form of leg in accordance with this invention.
Figure 8:
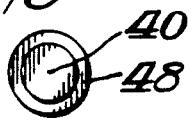
FIG. 8 is a top plan view of a portion of the leg shown in FIG. 7.
Figure 9:
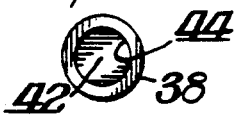
FIG. 9 is a top plan view of the other portion of the leg shown in FIG. 7.

FIG. 7 illustrates a modified leg 36 in accordance with this invention. As shown therein leg 36 includes a lower or outer tubular member 38 and an upper or inner tubular member 40. Member 38 has a partition 42 located closer to one end than to the other. Member 38 is of uniform thickness forming a pair of openings 44,46 with each respective opening being separated by partition 42. Upper member 40 is dimensioned to be snugly received in the respective openings or pockets 44,46. Upper member 40 is also provided with an annular stop ring 48 for engagement against the lower surface of a respective opening or pocket such as openings 24,26 previously described. Accordingly, the leg 36 provides added height adjustability in accordance with the selection of which opening 44 or 46 upper member 40 will be inserted into and in accordance with which opening 24 or 26 in the base 12 the composite leg assembly 36 will be inserted into.

Figure 10:
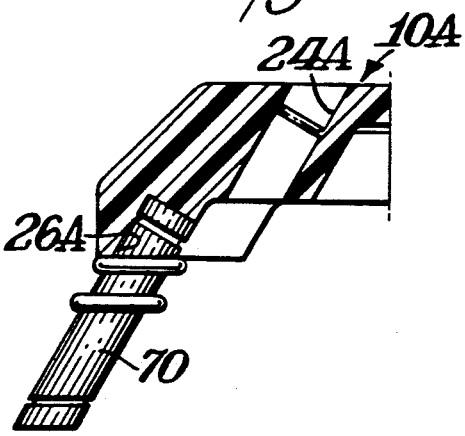
FIG. 10 is a view similar to FIGS. 5–6 showing a modified form of this invention.

It is to be understood that although each leg 20, 30, and 36 is shown as mounted perpendicularly with respect to platform 14, the legs may be mounted at an angle by suitably angling the lower portions of each leg 70 so that the lower portion will lie flat on the floor as shown in FIG. 10. Leg 70 is preferably at an angle of 30°-60° with respect to platform 14.

In accordance with a further aspect of this invention, each opening 24,26 is provided with an annular projection or bead 50 which functions as a lock member in connection with an annular groove 52 at each end of leg 20. Thus, when leg 20, 30 or 70 is telescoped into a respective opening the telescopic action will be limited by the abutment of a respective ring 22,23 with the lower surface around the opening. In addition the leg will be locked in place by bead 50 being engaged in groove 52. The leg can be released by a pull which would dislodge the groove/bead engagement. Although not illustrated, leg 36 may similarly have a groove in upper member 40. It is to be understood that the locking aspect may also be accomplished by providing the groove in the opening 24,26 and the bead on the leg.

It is also to be understood that the invention may be practiced with other forms of locking members and is not limited to the bead/groove form. Thus for example, other forms of interengaging structure may be used in the openings and on the legs.

Similarly, the invention is not limited to the plurality of openings in the illustrated forms. In a variation, for example, a pair of openings may be partially overlapped creating a formation similar to the figure eight. Additionally, the invention is not limited to one opening being in the apron and the other in the platform. Rather, both openings may be in either the apron or the platform.

Where one set of openings, such as openings 26 are open, or exposed at their top, such openings would be in effect closed when a leg 20, 30 or 36 is fully inserted therein.

A further variation of the invention is the inclusion of non-slip grommets (not shown) on the bottom of each leg.

A further aspect of this invention involves the convenient storage of the legs during periods of non-use. FIG. 3, for example, illustrates recesses 54 formed on the underside of platform 14 shaped to snugly receive each leg 20, 30, 36 or 70. Each recess 54 includes an enlarged portion 56 at one end thereof so that the user could pop out each leg by manipulation of the user's fingers or by a manipulating tool such as a screwdriver.

The invention thus provides a complete range of climbing heights for the aerobic exerciser while eliminating the necessity for a second set of legs. This is particularly advantageous since the invention permits the easy storage of the single set of legs which would be complicated if a second set of legs had to be stored. It is noted, with respect to the embodiment of FIG. 7 that additional height adjustability may be achieved by using upper member 40 alone or upper member 40 in assembly with lower member 38. For storage purposes, however, the entire leg assembly 36 could be stored as a single unit in any suitable manner, such as the snug reception in recesses 54.

With respect to the variation of FIG. 7, the securement of upper member 40 into lower member 38 may be achieved by providing a slight inward taper of each opening 44,46 as the opening approaches partition 42 so that there is a tight grip of upper member 40 when it is inserted into a respect opening 44,46.

A further variation to assure securing engagement of the two members in leg assembly 36 would be to provide posts or extensions on each side of partition 42 tightly engaged in respective openings in upper portion 40.

A further alternative for interlocking upper portion 40 to lower portion 38 would be to provide a hole in partition 42 and a projection from the lower end of upper portion 40 so that the projection would be engaged in the partition hole. This variation is not as desirable, however, since upper portion 40 would not be as readily usable as a leg alone without being coupled to lower portion 38.

The invention, thus provides a device which gives the user a complete range of heights in a single unit with only a single set of legs. Moreover, device 10 is portable and requires minimal storage space. In addition, by providing only a single set of legs, the device 10 is less expensive and easier to use while being less bulky.

What is claimed is:

1. An exercise device for use in aerobic step climbing, routines/programs comprising a base, said base consisting of a horizontal platform having opposite ends and intermediate sides with a downwardly extending apron extending from each of said ends and said sides, a corner where each of said ends is joined to each of said sides, a pair of leg receiving openings in each of said corners, and each of said leg receiving openings being of a different effective length than the length of the other of said leg receiving openings whereby a leg may be detachably inserted into a selected one of said openings to provide variable height adjustment of the distance of said platform in accordance with the selective mounting of the legs in said openings or in accordance with the absence of any legs from said openings.

2. The device of claim 1 in combination with a single set of four legs, and each of said legs being inserted into a respective one of said openings.

3. The device of claim 2 wherein each of said legs is adapted to be reversely mounted in a respective opening for providing two different lengths of leg exposed from its respective opening.

4. The device of claim 3 wherein each opening in said pair of openings is mounted at a different elevation than the other of said openings.

5. The device of claim 4 wherein each of said legs includes a stop member for engagement with the lower surface of said base around its respective opening.

6. The device of claim 5 including locking elements in each of said openings, and complementary locking openings on each of said legs.

7. The device of claim 6 wherein the underside of said base includes recesses for snugly receiving said legs in the stored condition of said legs, and said recesses having enlarged portions to facilitate the removal of said legs from said recesses.

8. The device of claim 5 wherein each of said legs is reversably mountable in its respective opening, said stop member being an annular projection around the surface of said leg, and said annular projection being located closer to one end of said leg than to the other end.

9. The device of claim 8 including a pair of said stop members on each of said legs.

10. The device of claim 9 including locking elements in each of said openings, and complementary locking openings on each of said legs.

11. The device of claim 10 wherein one of said pair of openings is located in said platform and the other of said openings is located in said apron.

12. The device of claim 5 wherein each of said legs comprises a leg assembly which includes an outer member and an inner member telescoped into said outer member.

13. The device of claim 12 wherein said outer member is hollow and includes a pair of leg receiving pockets separated by a partition, each of said pockets being of differing lengths, and the inner of said members being telescopically insertable into a respective one of said pockets.

14. The device of claim 13 wherein said stop member comprises an annular ring on said inner member located closer to one end of said inner member than to the other end.

15. The device of claim 1 wherein one of said openings is open at both ends.

16. The device of claim 2 wherein each of said legs is mounted perpendicularly with respect to said platform.

17. The device of claim 2 wherein said apron is outwardly inclined, and said legs being inclined with respect to said platform.

* * * * *